US006177174B1

(12) United States Patent
Legrand

(10) Patent No.: US 6,177,174 B1
(45) Date of Patent: Jan. 23, 2001

(54) ARMOR COATING FOR A METAL ENGINE COMPONENT, AND METHOD OF PRODUCING THE SAME

(75) Inventor: Norbert Legrand, Karlsfeld (DE)

(73) Assignee: MTU Motoren- und Turbinen-Union Muenchen GmbH, Munich (DE)

( * ) Notice: Under 35 U.S.C. 154(b), the term of this patent shall be extended for 0 days.

(21) Appl. No.: 09/113,880

(22) Filed: Jul. 10, 1998

(30) Foreign Application Priority Data

Jul. 12, 1997 (DE) ..... 197 30 008

(51) Int. Cl.[7] ..... B32B 17/00

(52) U.S. Cl. ..... 428/141; 428/142; 428/161; 428/163; 428/167; 428/469; 428/472; 427/318; 427/327; 427/330

(58) Field of Search ..... 428/141, 142, 428/154, 161, 163, 167, 469, 472; 451/51, 178, 49, 231, 530, 534, 900; 427/318, 327, 330

(56) References Cited

U.S. PATENT DOCUMENTS 4,594,053 6/1986 Söhngen .
5,472,745 * 12/1995 Schroder ..... 427/447
5,756,217 * 5/1998 Schroder ..... 428/469

FOREIGN PATENT DOCUMENTS 2703572 8/1977 (DE) .
4432998 * 9/1984 (DE) .
3413534 10/1985 (DE) .

* cited by examiner

*Primary Examiner*—Timothy M. Speer
(74) *Attorney, Agent, or Firm*—W. F. Fasse; W. G. Fasse

(57) ABSTRACT

An armor coating (3) is provided on a surface of a metal engine component (1) that is adapted to be in grazing contact with an abradable bedding-in seal lining provided on a second engine component. The armor coating (3) includes a ceramic layer (6) and has a profiled surface contour including peaks (4, 7, 9, 10) and depressions or grooves (5) therebetween. The grooves (5) serve to receive and carry away abrasion material that is abraded from the bedding-in lining. The profiled surface contour is formed in the surface (2) of the engine component (1) by cold deformation without material removal, and thereafter the ceramic layer (6) is applied thereon preferably by thermal spraying, such that the layer (6) follows and also embodies the profiled surface contour. The cold deformation is carried out by pressing a knurling tool (11) into the original un-profiled surface (2) of the component (1).

25 Claims, 4 Drawing Sheets

ARMOR COATING FOR A METAL ENGINE COMPONENT, AND METHOD OF PRODUCING THE SAME

PRIORITY CLAIM

This application is based on and claims the priority under 35 U.S.C. §119 of German Patent Application 197 30 008.1, filed on Jul. 12, 1997. The entire disclosure of German Patent Application 197 30 008.1 is incorporated herein by reference.

FIELD OF THE INVENTION

The invention relates to an anti-wear or armor coating provided on the surface of a metal engine component, which is to make grazing contact with and be abrasively bedded into a bedding-in coating or lining on a second component of the engine. The armor coating comprises a ceramic layer having alternating peaks and depressions therebetween for receiving and carrying away abrasion material. This armor coating is especially for the rotor or stator of a jet turbine engine. The invention further relates to a method of providing such an armor coating on a metal engine component.

BACKGROUND INFORMATION

Armor coatings and/or abradable bedding-in linings are provided on engine components such as on the tips of sealing fins of labyrinth seals or the tips of rotor blades, in order to hinder the abrasive wear of the coated components during grazing contact between the armored component and the other component provided with a bedding-in coating. Since the efficiency of a compressor or a turbine is largely dependent on the gap width between the rotating component and the stationary component, this efficiency is reduced with increasing abrasive wear, for example of the blade tips, as a result of grazing contact processes.

Generally, the armor coating abrades or cuts itself into an opposing bedding-in coating of a second component during operation of the engine. Such bedding-in coatings generally consist of a layer of an abradable, corrosion resistant and erosion resistant material. However, if the strength and hardness of the bedding-in coating is increased in order to increase the erosion and temperature resistance thereof, then the abrasive wear of the engine components will also be increased, so that it is necessary to provide an armor coating thereon. By providing such an armor coating, it is achieved that a minimized gap width will be formed between the armor coating and the bedding-in coating as a result of the grazing contact therebetween.

Known armor coatings comprise a ceramic layer that is thermally sprayed onto the surface of the respective engine component. In order to provide, on the armor coating, a profiled surface having edges or peaks that are adapted to cut into the opposing bedding-in coating, as well as free spaces or depressions between respective peaks for receiving and carrying away the abraded material, the known thermal spray process is carried out using a perforated mask consisting of a wire mesh arranged over the component surface. Then the coating material is sprayed through the wire mesh mask, whereby the spray is selectively blocked in a pattern determined by the mask so as to form peaks and depressions in the spray coating applied to the engine component. The size and geometry of the respective peaks or edges is determined and may be varied by the position and type of wire mesh that is used as the mask, as well as the spraying stream angle and the like.

In practice, this known process has been found to suffer several disadvantages. First, it has been found that the wire mesh completely covers the component surface or completely blocks the spray application at certain locations and thereby causes the formation of defects, gaps or voids in the coating layer. This also causes undesirable variations in the coating layer thickness, and makes it impossible to achieve a uniform surface profiling over the entire circumference of the component. Furthermore, the known process requires a complicated preparation of the component surface as well as handling of the wire mesh, and involves difficulties in maintaining the required spraying stream angle and limiting that angle to the range specified by the known process.

SUMMARY OF THE INVENTION

In view of the above, it is an object of the invention to provide an armor coating of the above described general type, which comprises a coating layer and surface profiling that are as uniform as possible over the entire workpiece surface to be coated. It is a further object of the invention to provide a method of providing such an armor coating on an engine component in a manner that is production-technically simple, cost economical, and reliable. The invention further aims to overcome or avoid the disadvantage of the prior art, and to achieve additional advantages, as apparent from the present description.

The above objects have been achieved by an armor coating on a metal engine component according to the invention, wherein the armor coating comprises a ceramic layer that is applied onto a surface of the engine component, and that has a profiled surface including peaks and free spaces or depressions between the peaks for carrying away abraded material when the armor coating makes grazing contact with a bedding-in coating of another engine component. Further according to the invention, the profiled surface of the armor coating is formed by providing a corresponding profiled surface on the engine component itself, and particularly by plastically deforming the surface of the engine component, before applying the armor coating thereon.

Thus, the engine component itself has a profiled surface including peaks and valleys or depressions, which have been formed by cold working deformation, whereby the material of the engine component is compressed and hardened. Namely, in order to form such a profiled surface, material is not machined or otherwise removed from the engine component. Instead, the surface of the component is formed and compressed by cold forming processes in order to produce the peaks and depressions therebetween. To achieve this, an appropriate tool is pressed into the surface of the engine component before it is coated with the ceramic armor coating material. The depressions may be in the form of valleys, grooves, notches, pits, troughs, indentations or the like.

Thereafter, the armor coating is applied onto the profiled surface of the engine component, whereby the armor coating itself advantageously has a uniformly profiled and coated surface, without requiring the complicated use of a wire mesh or other screening mask for covering portions of the component surface. Furthermore, the present method avoids the formation of the defects that typically arise to a great extent when using such a wire mesh mask. A further advantage is that the armor coating may have deeper grooves or other depressions than can be achieved by prior art methods. In this context, the profiled surface of the armor coating can be embodied exactly as needed to provide an optimum abrasive wear with consideration of the relative motion between the engine component having the armor coating thereon and the second engine component that may have a bedding-in coating thereon.

In a preferred embodiment of the invention, a knurling operation is carried out for profiling the surface, i.e. deforming the surface by cold working to achieve the desired profile. This knurling operation is carried out by pressing a knurling tool into the surface of the engine component that is to be armor coated. In this context, standardized knurling forms with numerous different diameters, profile angles and pitches, may be used, such as knurling tools with flutes parallel to the axis of the tool, right or left spiraling flutes or knurlings, combined left and right spiral knurlings or cross knurlings with raised or depressed peaks, for example. In the event special component configurations are to be profiled, then special knurling tools can be produced for carrying out the profiling.

It may be suitable for particular applications, if the peaks and depressions forming the profiled surface extend substantially parallel to a rotational axis of the component. Throughout this specification, it should be understood that the term "rotational axis" of the armor-coated engine component refers to an axis about which the armor-coated engine component or some other cooperating component of the engine rotates. Namely, the armor-coated component may be a non-rotating stator component, but is understood to have a "rotational axis" as its central axis aligned with the rotation axis of a cooperating rotor component.

Alternatively, in a preferred embodiment, the peaks and depressions forming the profiled surface extend at an angle relative to the above defined rotational axis, whereby a left or right spiraling knurling tool is used to form these peaks and depressions. In comparison to the above mentioned axis-parallel knurling, this spiral knurled configuration has the advantage that the depressions or grooves will receive and simultaneously move or clear away the abrasion material.

It is further advantageous if the profiling pattern includes a first row of respective peaks and depressions that extend parallel to one another and at an angle relative to the rotation axis, and a second row of peaks and depressions that extend parallel to each other and at an angle relative to the rotation axis while crossing the first row of peaks and depressions. In this manner, for example, it is possible to provide a proper profiling pattern adapted to the respective relative motion between the two components in the particular application.

In a preferred embodiment, the peaks, and particularly the edges of the peaks, forming the profiled surface are configured so as to be cutting edges, so that the profiled armor coating may easily work or cut itself into the bedding-in coating provided on a second component. The orientation of the cutting edges of the peaks is selected in consideration of the relative motion between the first and second engine components.

According to particular details of the invention, the peaks may be 0.5 mm thick or wide, whereby the peaks preferably have a flattened or plateau surface. In certain applications, it is advantageous if the flanks or side surfaces of the peaks extend asymmetrically relative to each other. A preferred knurling depth of the depressions measured relative to the highest points of the peaks is 0.8 mm, which is greater than the corresponding depths that can be achieved using known methods. Preferably, the pitch or adjacent spacing of the peaks is 1.6 mm, but larger peak spacings have also been found to be suitable in certain applications. The ceramic layer preferably comprises a substantially uniform thickness over the entire surface of the component that is to be armor coated, wherein the term "substantially uniform" refers to a typical deviation from a nominal layer thickness that typically arises in connection with the respective coating application technique used to apply the coating. This uniformity is achieved over the entire surface to be coated especially because the surface profiling is formed in the base material of the component itself, and the ceramic layer is then formed uniformly over the profiled component. The ceramic layer is preferably thinner than the height and pitch spacing of the peaks, so that the ceramic layer follows and matches the profile of the underlying profiled surface of the engine component.

In a preferred embodiment, the armor coating is provided on an inner diameter or radially inwardly facing surface of an engine component such as a so-called FIN component, namely a seal disk for a labyrinth seal. In this application, the peaks and depressions of the profiled surface are easily formed using a standard knurling tool that has a knurled profile on its outer diameter, i.e. its outer surface. Alternatively, the armor coating may be provided without problems on the outer diameter, i.e. the radially outwardly facing surface, of engine components such as blade tips or seal tips of a blade tip shroud band.

The above objects have further been achieved in a method for providing an armor coating on a surface of a metal engine component according to the invention, including a step of forming a profiled surface by deforming the surface of the component that is to be armor coated, and then a step of coating the profiled surface of the component with a layer of ceramic material. The advantage of this method is that the prior profiling step makes it possible to avoid the formation of defects in the subsequently formed ceramic layer. Preferably, the profiling is carried out by knurling, so that profiled surfaces having various different forms and geometries can easily be produced by simply pressing standardized knurling tools into the corresponding component surface. It is further advantageous if the armor coating of the previously profiled component surface is achieved by thermally spraying a ceramic material thereon. It can also be advantageous if the method involves a further step of finish turning the component, for example if the profiling step causes a deformation of the base material of the engine component as a result of the cold working compression thereof.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
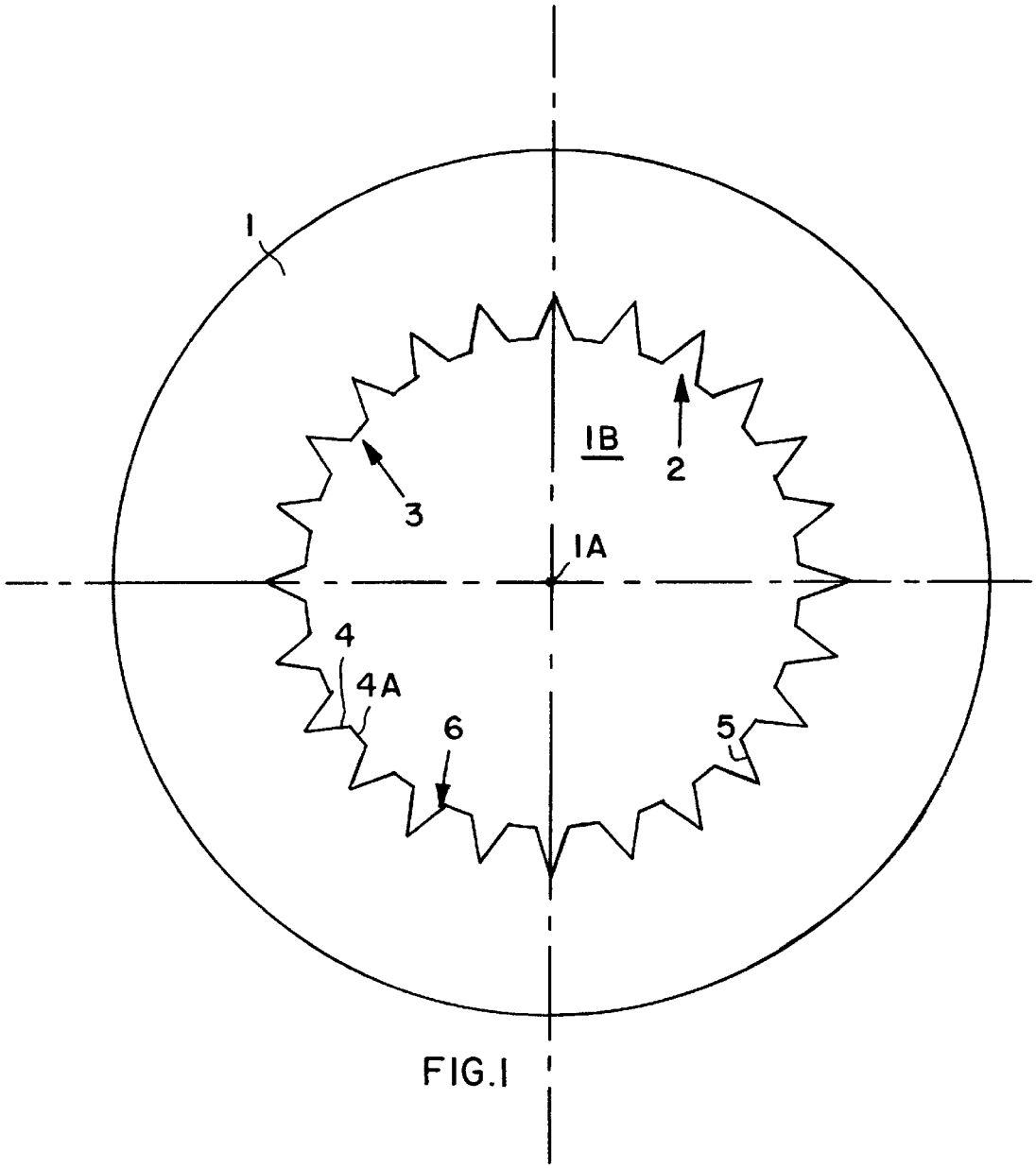
FIG. 1 is a schematic plan view of a running disk or seal disk for a labyrinth seal, having an armor coating according to a first embodiment of the invention provided on an inner circumferential surface thereof, whereby the relative proportions of the profiled armored surface have been greatly enlarged for the sake of clarity.

FIG. 1 is a schematic plan view of a running disk or seal disk 1 for a labyrinth seal of a jet turbine engine or the like. The seal disk 1 has an inner bore 1B bounded by an inner circumferential surface 2 with sealing tips that will form a seal in cooperation with an abradable bedding-in lining on another engine component (not shown). The seal tips are provided with an armor coating according to a first example embodiment of the invention. The armor coating 3 comprises a ceramic layer 6 that has a surface profile including peaks 4 with flat top plateaus 4A and free spaces or depressions 5 located between respective peaks 4. Generally, the ceramic layer 6 is thermally sprayed onto the previously profiled inner circumferential surface 2 of the engine component, i.e. the seal disk 1. The ceramic material for the ceramic coating 6 is $Al_2O_3$ in the form of corundum for example.

The original or starting shape of the inner circumferential surface 2 of the seal disk 1 is a uniform non-profiled cylindrical bore, for example. According to the invention, the desired profiled surface contour is first formed in the inner circumferential surface 2 of the seal disk 1, before the ceramic layer 6 is applied thereon. To achieve this, a knurling tool corresponding to the desired profile shape is pressed against the inner circumferential surface 2, whereby the circumferential surface 2 or especially its base material is cold-deformed and compressed to the desired profile shape. Next, the thusly profiled inner circumferential surface 2 is coated with the ceramic material so as to form a uniform ceramic layer 6, using any known coating technique, but preferably using thermal spraying.

In the example embodiment of FIG. 1, the peaks 4 as well as the free spaces or depressions 5 extend parallel to a rotation axis 1A that extends perpendicularly to the plane of the drawing. This profile shape is formed using a knurling tool having axis-parallel flutes or knurling ridges and an appropriate corresponding shape, knurling pitch or spacing T and the like, whereby the knurling tool is simply pressed into the inner circumferential surface 2 of the seal disk 1 without causing a removal of material.

The depressions 5 between the peaks 4 are provided for the following reason. When the seal disk 1 of the labyrinth seal is arranged in its final installation in an engine or the like, a second engine component provided with a bedding-in coating cooperates with the inner circumferential surface 2 provided with the armor coating 3, such that the armor coating 3 and the bedding-in coating are in grazing contact with one another. As a result of this grazing contact, hot abrasion material is abraded from the bedding-in coating and is received and carried away in the depressions 5. The flattened or plateau peaks 4 have been found in practice to be very reliable for a long operating life due to their strength and load bearing capacity. To ensure that the flattened peaks 4 easily cut or work into the bedding-in coating, the peaks 4 are preferably so configured as to have edges capable of cutting.

Figure 2:
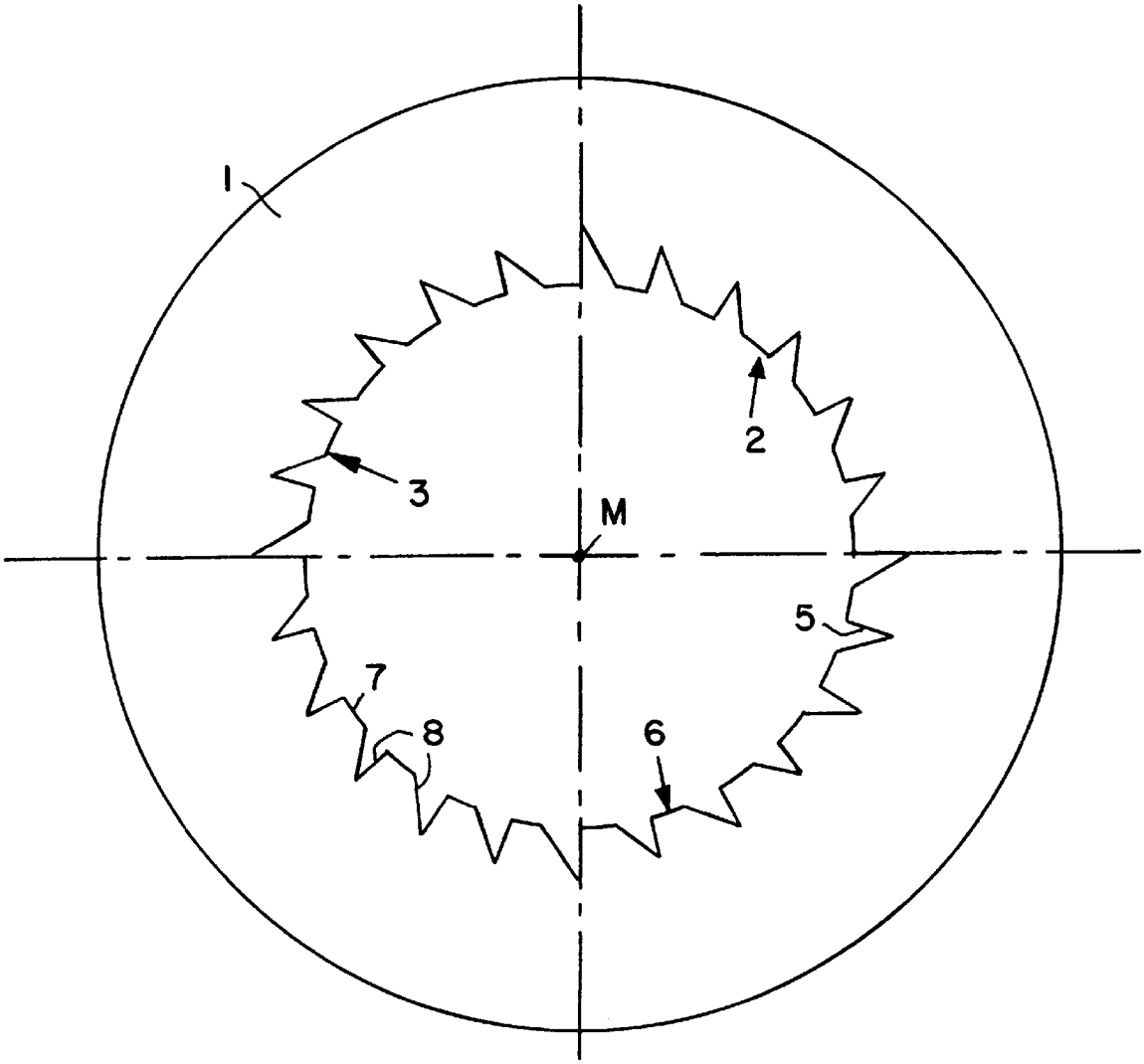
FIG. 2 is a schematic plan view similar to that of FIG. 1, but showing a seal disk having an armor coating according to a second embodiment of the invention.

FIG. 2 shows a second example embodiment of an armor coating 3 according to the invention which similarly comprises flattened or plateau peaks 7. However, the present peaks 7 are different from the peaks 4 of the embodiment according to FIG. 1, in that they have an asymmetrical shape, i.e. the side flanks 8 of each peak 7 are not symmetrical but instead have different slope angles on the left side and on the right side of each peak 7. The flanks 8 generally extend at an angle relative to a respective radial line extending radially outwardly from a centerpoint M of the seal disk 1. In the illustrated example, the left side flanks 8 extend along the radial lines, while the right side flanks 8 extend at a slope angle relative to the radial lines. Such a configuration of the flanks 8 is advantageous in certain applications for improving the ability of the armor coating 3 to work or cut into the bedding-in coating of a second engine component, and for carrying away the resulting abrasion material. An armor coating 3 with such a profiled configuration is also formed by pressing a correspondingly shaped knurling tool into the inner circumferential surface 2 of the seal disk 1 without removing any material. Then, the ceramic layer 6 is applied onto the profiled inner circumferential surface 2 so as to uniformly and completely coat the peaks 7 and the depressions 5.

Figure 3:
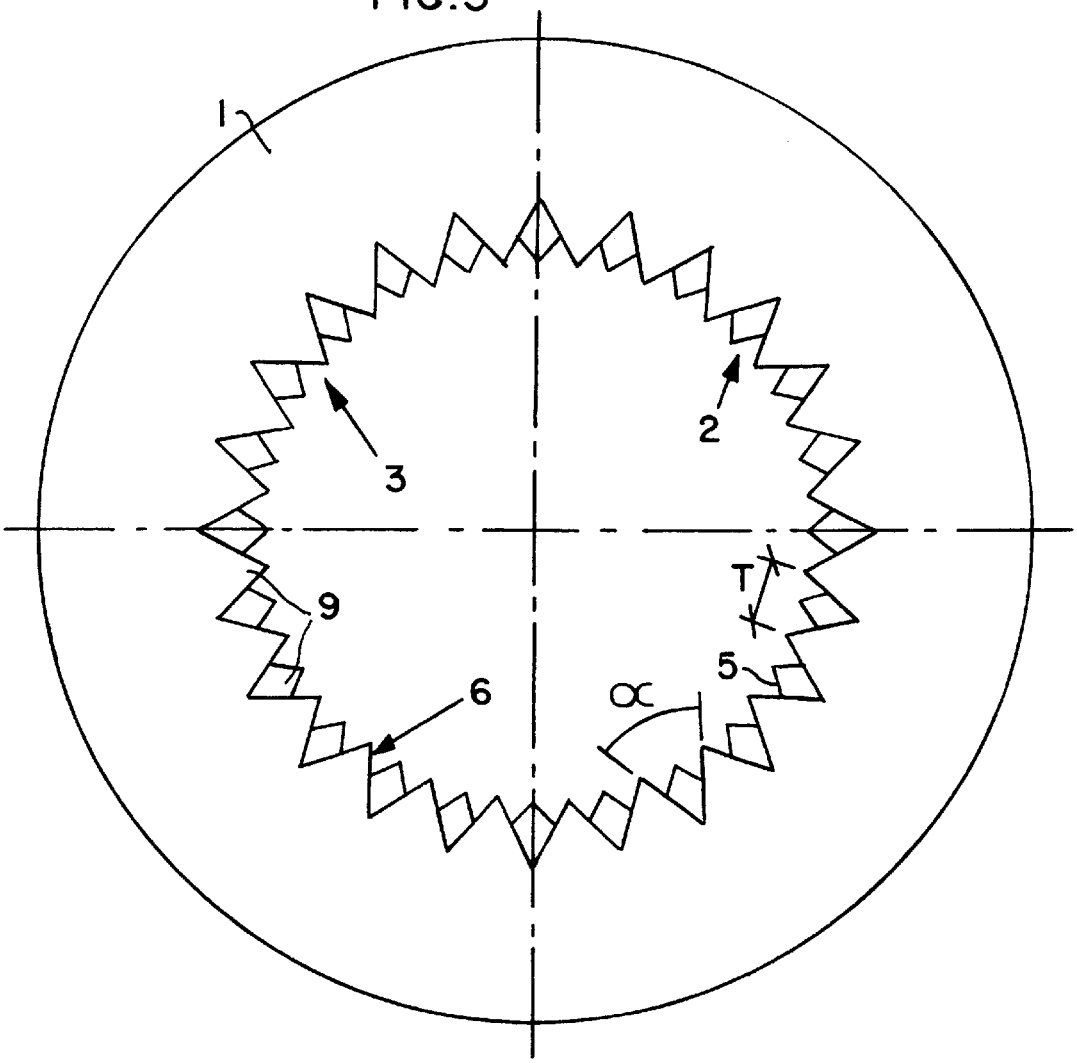
FIG. 3 is a schematic plan view similar to that of FIG. 1, but showing a seal disk having an armor coating according to a third embodiment of the invention.

FIG. 3 shows a third example embodiment of an armor coating 3 provided on a seal disk 1 according to the invention. The armor coating 3 in this embodiment has peaks 9 that are different from the previously described peaks. Namely, the peaks 9 and the depressions 5 therebetween do not extend parallel to an axis of the seal disk 1, but instead are formed as left and right spiral knurls. Such a profiled configuration is formed using a so called left-right spiral knurling tool. Alternatively, the knurling could be formed as a left hand knurling or as a right hand knurling. In comparison to the axis-parallel knurling described in relation to the above embodiments, the present profile having spiral knurling and particularly left and right spiral knurling has the advantage that the grooves 5 not only receive or take up the hot abrasion material abraded from the bedding-in coating provided on a second engine component, but additionally carry and push away this abrasion material.

The peaks 9 in the embodiment of FIG. 3 are also distinguished from the peaks of the previously described embodiments in that they are not flattened, but rather come to a pointed tip or edge. Also, as apparent in FIG. 3, the specific type of knurling used in this example results in overlapping rows of peaks 9, with the peaks 9 of a second row aligning axis-parallel with the depressions 5 of a first row. FIG. 3 also shows the peak spacing or pitch T, which is greater than 1.6 mm for most applications, as well as the profile angle $\alpha$ defining the angle of the depressions 5 between respective peaks 9. The specific angle $\alpha$ must be selected or adapted for each respective application. For simplifying the fabrication, standardized knurling tools may also be used for forming such profiled surfaces, whereby such standardized knurling tools are readily available for a large range of different diameters and peak spacings or pitches T.

Figure 4:
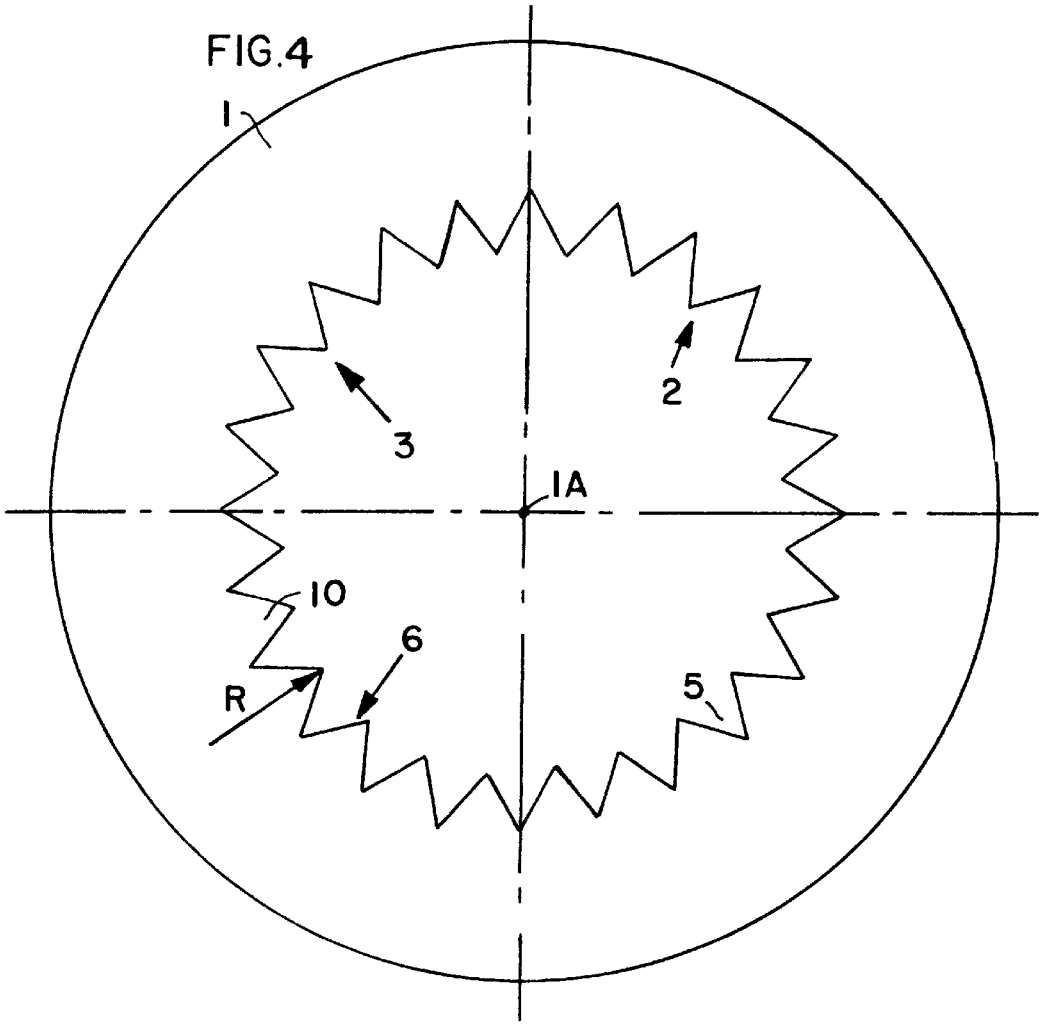
FIG. 4 is a schematic plan view similar to that of FIG. 1, but showing a seal disk having an armor coating according to a fourth embodiment of the invention.

FIG. 4 shows another example embodiment in which the inner circumferential surface 2 of a running or seal disk 1 for a labyrinth seal has an armor coating 3 with fully formed, i.e. not flattened, peaks 10. The peaks 10 extend axis-parallel, i.e. parallel to an axis 1A of the seal disk 1 extending perpendicularly to the plane of the drawing. The tip or peak edge of each peak 10 is rounded with a small radius R. In FIG. 4, the relative length of the radius line R has been exaggerated for clarity. Such peaks 10 are readily formed using a knurling tool having axis-parallel flutes or ridges, such as the knurling tool shown schematically in three views in FIGS. 5A, 5B and 5C.

Figure 5A:
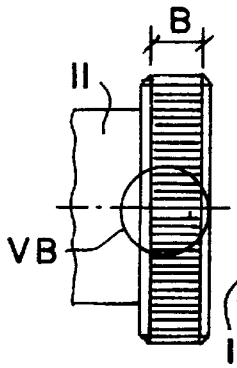
FIG. 5A is a schematic side view of a knurling tool that is used for forming the profiled surface of the armor coating according to the invention.
Figure 5B:
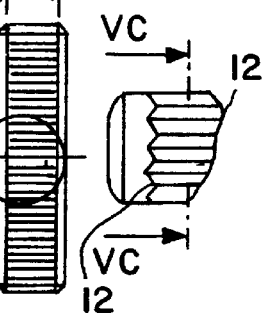
FIG. 5B is an enlarged detail view of the area VB of the knurling of the knurling tool shown in FIG. 5A.
Figure 5C:
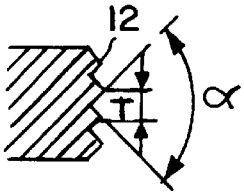
FIG. 5C is a schematic sectional view taken along the section line VC—VC in FIG. 5B.

FIG. 5A is a side view of a knurling tool 11 that can be used for forming the profiled surface on the inner circumferential surface 2 of an engine component 1, such as the seal disk 1 shown in any one of FIGS. 1 to 4, or particularly a so-called FIN component. In the illustrated example, the knurling tool 11 has fully formed (i.e. not flattened) peaks 12, which especially substantially correspond to the peaks 10 of the armor coating 3 in the example embodiment of FIG. 4. The width B of the knurling tool 11 is matched to the desired width of the surface of the engine component that is to be provided with an armor coating in each particular application. FIG. 5B shows an enlarged detail view of the knurling peaks or ridges 12, and FIG. 5C shows a sectional view of these knurling peaks or ridges 12. As can be seen in FIG. 5C, the peak spacing or pitch T, and the profile angle $\alpha$ of the peaks or ridges 12 of the knurling tool 11 correspond to the pitch T and angle $\alpha$ of the desired finished profiled contour.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A metal engine component with an armor coating on a surface thereof, wherein:

said surface of said engine component and said armor coating each respectively have a profiled surface contour including peaks and depressions between said peaks, said profiled surface contour of said armor coating follows and matches said profiled surface contour of said surface of said engine component lying thereunder, said profiled surface contour of said surface of said engine component is a plastically deformed, compressed and work-hardened surface contour formed by plastically deforming said surface of said engine component, and said armor coating comprises a ceramic layer applied on said profiled surface contour of said surface of said engine component.

2. The metal engine component with the armor coating according to claim 1, further in combination with a second engine component with an abradable bedding-in coating on a surface thereof, wherein said metal engine component and said second engine component are so arranged that said armor coating is in grazing contact with and abrasively beds into said bedding-in coating, and wherein said depressions are adapted to receive and carry away abrasion material abraded from said bedding-in coating.

3. The metal engine component with the armor coating according to claim 1, wherein said peaks and said depressions respectively comprise knurling ridges and knurling grooves.

4. The metal engine component with the armor coating according to claim 1, wherein said peaks and said depressions respectively extend parallel to a rotation axis of said engine component.

5. The metal engine component with the armor coating according to claim 1, wherein said peaks and said depressions respectively each extend along a spiral at an angle to a rotation axis of said engine component.

6. The metal engine component with the armor coating according to claim 1, wherein said peaks and said depressions include a first row of peaks and depressions that extend parallel to each other along respective first spirals at an angle to a rotation axis of said engine component, and a second row of peaks and depressions that extend parallel to each other along respective second spirals at an angle to said rotation axis and that crosses said first row of peaks and depressions.

7. The metal engine component with the armor coating according to claim 1, wherein each one of said peaks has a cutting edge adapted to cut.

8. The metal engine component with the armor coating according to claim 1, wherein each one of said peaks has a width of 0.5 mm.

9. The metal engine component with the armor coating according to claim 1, wherein each one of said peaks includes a flat top plateau and side flanks extending therefrom.

10. The metal engine component with the armor coating according to claim 1, wherein each one of said peaks has first and second side flanks that are asymmetrical relative to each other.

11. The metal engine component with the armor coating according to claim 10, wherein said first side flank of each said peak extends along a respective radial plane of said engine component, and said second side flank of each said peak does not extend along but slopes relative to a respective radial plane of said engine component.

12. The metal engine component with the armor coating according to claim 1, wherein said depressions have a depth of 0.8 mm measured relative to said peaks.

13. The metal engine component with the armor coating according to claim 1, wherein a pitch spacing of said peaks relative to one another is at least 1.6 mm.

14. The metal engine component with the armor coating according to claim 1, wherein said ceramic layer has a substantially uniform thickness everywhere over said profiled surface contour of said surface of said engine component.

15. The metal engine component with the armor coating according to claim 1, wherein said surface is a radially inwardly facing inner circumferential surface of said engine component.

16. The metal engine component with the armor coating according to claim 1, wherein said surface is a radially outwardly facing outer circumferential surface of said engine component.

17. The metal engine component with the armor coating according to claim 1, wherein said engine component is a seal disk of a labyrinth seal of a jet turbine engine.

18. The metal engine component with the armor coating according to claim 1, wherein said depressions comprise V-shaped grooves.

19. The metal engine component with the armor coating according to claim 17, wherein said grooves include a first set of grooves spiraling in a first direction and a second set of grooves spiraling in a second direction and intersecting said first set of grooves.

20. The metal engine component with the armor coating according to claim 1, wherein said ceramic layer comprises $Al_2O_3$.

21. A method of making the metal engine component with the armor coating according to claim 1, comprising the following steps:

a) providing a raw engine component having an initial surface that is to be armor coated;

b) plastically deforming said initial surface to form a profiled surface having peaks and depressions between said peaks; and c) coating said profiled surface with a layer of ceramic material.

22. The method according to claim 21, wherein said step of plastically deforming said initial surface comprises pressing a knurling tool into said initial surface.

23. The method according to claim 21, wherein said step of coating said profiled surface comprises thermally spraying said ceramic material onto said profiled surface.

24. The method according to claim 21, further comprising a step of finish turning said engine component after said step c).

25. The method according to claim 21, wherein said step of plastically deforming said initial surface comprises cold plastic deforming of said initial surface without removal of material therefrom.

* * * * *

UNITED STATES PATENT AND TRADEMARK OFFICE

CERTIFICATE OF CORRECTION

PATENT NO. : 6,177,174 B1
DATED : January 23, 2001
INVENTOR(S) : Legrand

It is certified that error appears in the above-identified patent and that said Letters Patent is hereby corrected as shown below:

Title Page,
Item [56], References Cited, Under FOREIGN DOCUMENTS:
Line 2, replace "1984" by -- 1994 --;

Column 8,
Line 61, after "claim", repace "17" by -- 18 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*